US007040268B1

(12) United States Patent
Fonville et al.

(10) Patent No.: US 7,040,268 B1
(45) Date of Patent: May 9, 2006

(54) ENGINE COVER BRACE ASSEMBLY

(75) Inventors: Carl E. Fonville, Ann Arbor, MI (US); Michael A. Karram, Flint, MI (US)

(73) Assignee: General Motors Corporation, Detroit, MI (US)

( * ) Notice: Subject to any disclaimer, the term of this patent is extended or adjusted under 35 U.S.C. 154(b) by 14 days.

(21) Appl. No.: 10/965,389

(22) Filed: Oct. 14, 2004

(51) Int. Cl.
*F01M 9/10* (2006.01)

(52) U.S. Cl. ..... 123/90.37; 123/90.38; 277/591

(58) Field of Classification Search ..... 123/90.37, 123/90.38, 193.5, 195 C, 198 E; 277/591, 277/651, 652
See application file for complete search history.

(56) References Cited

U.S. PATENT DOCUMENTS 5,255,647 A * 10/1993 Kiczek ..... 123/195 C
5,323,740 A * 6/1994 Daily et al. ..... 123/90.38
6,591,801 B1 7/2003 Fonville ..... 123/90.38

* cited by examiner

*Primary Examiner*—Thomas Denion
*Assistant Examiner*—Ching Chang
(74) *Attorney, Agent, or Firm*—Christopher DeVries

(57) ABSTRACT

A sealed cover assembly for a fluid-containing cavity of an engine includes a cover including a fluid-containing wall with a peripheral edge having a sealing surface adapted to oppose a corresponding sealing surface of the engine, and a plurality of mounting openings in the peripheral edge; a reaction pad adjacent each of the openings and disposed at the peripheral edge on an opposite surface of the sealing surface around a perimeter defining the cover; a brace disposed against the reaction pad around the perimeter defining the cover; and mechanical fasteners extending through the reaction pad and the brace for securing the cover to a mating edge of the engine cavity, the fasteners when engaged providing substantially equal compression forces on the reaction pad via the brace and supporting the cover sealing surface with a predetermined gap from the cavity mating edge for engagement with a compliant sealing material disposed between the surfaces.

20 Claims, 3 Drawing Sheets

ENGINE COVER BRACE ASSEMBLY

BACKGROUND

The present disclosure relates generally to engine covers, such as valve or rocker covers, and more particularly to an apparatus and method for mounting the engine cover on an engine.

The use of overhead valve and overhead cam engines is well known in the automotive and motorcycle industry. These engines have several distinguishing features, one of which is a valve cover mounted on the cylinder head. The valve cover defines the upper portion of either the rocker box (for overhead valve engines) or the cam case (for overhead cam engines).

The valve cover is typically a cast, stamped, or molded one-piece rigid structure that has a lower peripheral edge corresponding in shape to the upper peripheral edge of the cylinder head. The valve cover is mounted on the cylinder head over the valve drive (e.g., rockers or cams and valves). A sealing gasket is commonly used to seal the joint between the cylinder head and the valve cover.

In general, conventional gaskets require a relatively high compressive load between the members being sealed in order for the gasket to provide an effective seal. For example, a gasket placed between two stationary members, such as an engine block and an oil pan, or an cylinder head and a valve cover, is compressed between these elements. However, while producing an effective seal, these highly compressed gaskets can become a medium for transmitting noise, vibration and harshness (NVH) characteristics between the two members. That is, the vibration load input from one member is easily transferred through either the gasket or direct contact with the other member. Moreover, in these applications that require the high compressive sealing load, the number and placement of fasteners must compensate for deflections of the cover caused by the high loading conditions in order to assure a good seal.

Examples of such conventional gaskets requiring a high sealing load between the members include an elastomeric gasket shaped as an O-ring or similar shape, as well as an edge bond gasket, a carrier gasket, and a rubber coated metal (RCM) gasket. Since all of these conventional gaskets require a high compressive sealing load to assure an effective seal between the members, the effectiveness of vibrational isolation of one member from the other is poor. Another example of a conventional gasket is one formed from a room temperature vulcanization (RTV) located between the two members. The RTV is applied as a liquid in a thin layer and cures when exposed to air. For effective sealing with the RTV, however, it requires a hard mount between the members, which also provides poor vibration isolation.

It is known in the art relating to engine valve and rocker covers to provide a gasket and grommet mounting in a noise isolation system which interrelates the sealing performance and noise isolation in a robust cover design. Noise isolation is provided by mounting a cover with a grommet at each hold down bolt location and by a peripheral molded seal or gasket between the cover and the engine cylinder head or block which separates the cover from direct metal to metal contact (see FIG. 3). However, there are always one or more issues with respect to at least one of the proper number of bolts, the span between bolts, overloaded grommets, under loaded gaskets and the structural integrity of the cover. More specifically, the forces required to seal the molded gasket may be unevenly applied because of variations in the bolt pattern and spacing resulting in differing grommet loads and sealing variations at various locations around each part. Control of noise isolation may be compromised due to non-uniform compression sealing of the gasket, varying grommet loads and reaction distortions in the cover.

Accordingly, a cover mounting system which maximizes NVH isolation, provides an adequate uniform sealing function and minimizes structural requirements is desired.

BRIEF DESCRIPTION

Disclosed herein is a sealed cover assembly for a fluid-containing cavity of an engine includes a cover including a fluid-containing wall with a peripheral edge having a sealing surface adapted to oppose a corresponding sealing surface of the engine, and a plurality of mounting openings in the peripheral edge; a reaction pad adjacent each of the openings and disposed at the peripheral edge on an opposite surface of the sealing surface around a perimeter defining the cover; a brace disposed against the reaction pad around the perimeter defining the cover; and mechanical fasteners extending through the reaction pad and the brace for securing the cover to a mating edge of the engine cavity, the fasteners when engaged providing substantially equal compression forces on the reaction pad via the brace and supporting the cover sealing surface with a predetermined gap from the cavity mating edge for engagement with a compliant sealing material disposed between the surfaces.

An engine cover assembly defining a fluid-containing cavity is further disclosed, which includes an engine component including a sealing surface defining an edge of the cavity; a cover including a fluid-containing wall surrounded by a peripheral edge and having a sealing surface opposing the sealing surface of the engine component, and a plurality of mounting openings in the wall; a reaction pad adjacent each of the openings and disposed at the peripheral edge on an opposite surface of the sealing surface around a perimeter defining the cover; a brace disposed against the reaction pad around the perimeter defining the cover, the brace including a plurality of height limiters depending therefrom and aligned with each of the openings; and mechanical fasteners extending through the reaction pad and each height limiter for engaging the engine component for securing the cover to the engine component, the fasteners when engaged providing equal compression forces on the reaction pad via the brace and supporting the cover sealing surface with a predetermined gap from the cavity mating edge for engagement with a compliant sealing material disposed between the surfaces.

Also disclosed is a method for a method for sealing an engine cavity, which includes configuring a cover including a fluid-containing wall with a peripheral edge having a sealing surface adapted to oppose a corresponding sealing surface of an engine; configuring a plurality of mounting openings in the peripheral edge; disposing a reaction pad adjacent each of the openings and around at the peripheral edge on an opposite surface of the sealing surface around a perimeter defining the cover; disposing a brace against the reaction pad around the perimeter defining the cover; and extending mechanical fasteners through the reaction pad and the brace for securing the cover to a mating edge of the engine cavity, the fasteners when engaged providing equal compression forces on the reaction pad via the brace and supporting the cover sealing surface with a predetermined gap from the cavity mating edge for engagement with a compliant sealing material disposed between the surfaces.

The above-described and other features are exemplified by the following figures and detailed description.

BRIEF DESCRIPTION OF THE DRAWINGS

Referring now to the figures, which are meant to be exemplary embodiments, and wherein like elements are numbered alike.

DETAILED DESCRIPTION OF THE PREFERRED EMBODIMENT

The present disclosure provides a cover assembly for an engine that provides a uniform standoff height around a perimeter defining the cover assembly that prevents hydraulic lift of the cover assembly when a gasket between the cover assembly and engine heats up and expands as a thick fluid medium. The uniform standoff height provides a space for the gasket to flow without hydraulically lifting the cover assembly from the engine. The standoff height also allows isolation of, or at least limits, engine noise radiating from the cover assembly dependent on a height of a limiter and/or reaction pad material intermediate the limiter and the cover assembly. The cover assembly eliminates mid-span deflection of the cover assembly intermediate bolt bosses with a uniform reaction load around a perimeter of the cover assembly.

Figure 1:
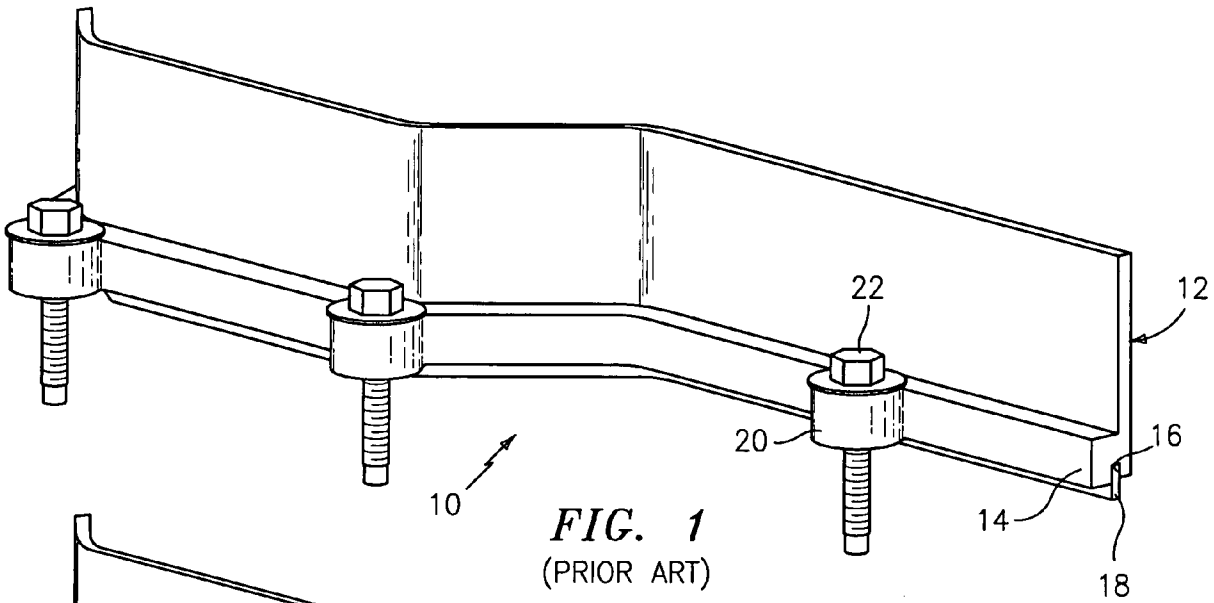
FIG. 1 (PRIOR ART)
FIG. 1 is a perspective view of a prior art rocker cover having a gasket in a groove of the rocker cover that is hard mounted to a cylinder head providing no cover standoff height due to direct contact with the cylinder head.
Figure 2:
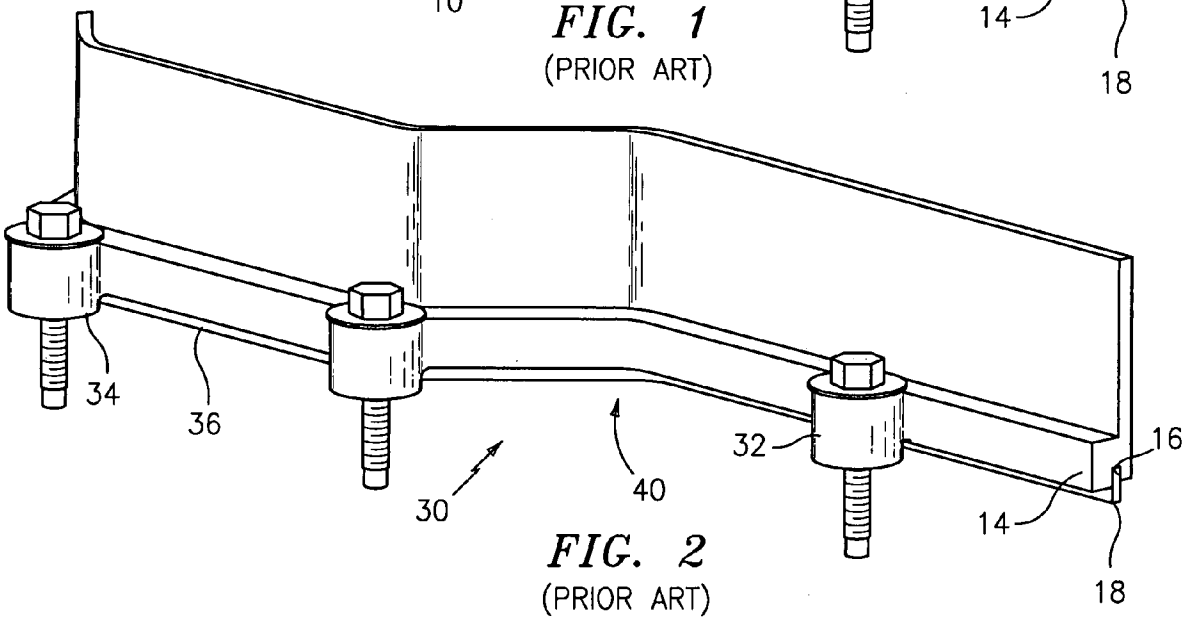
FIG. 2 (PRIOR ART)
FIG. 2 is a perspective view of a prior art rocker cover having a gasket in a groove of the rocker cover that is hard mounted to a cylinder head only at bolt bosses of the cover providing standoff height intermediate the bolt bosses.
Figure 3:
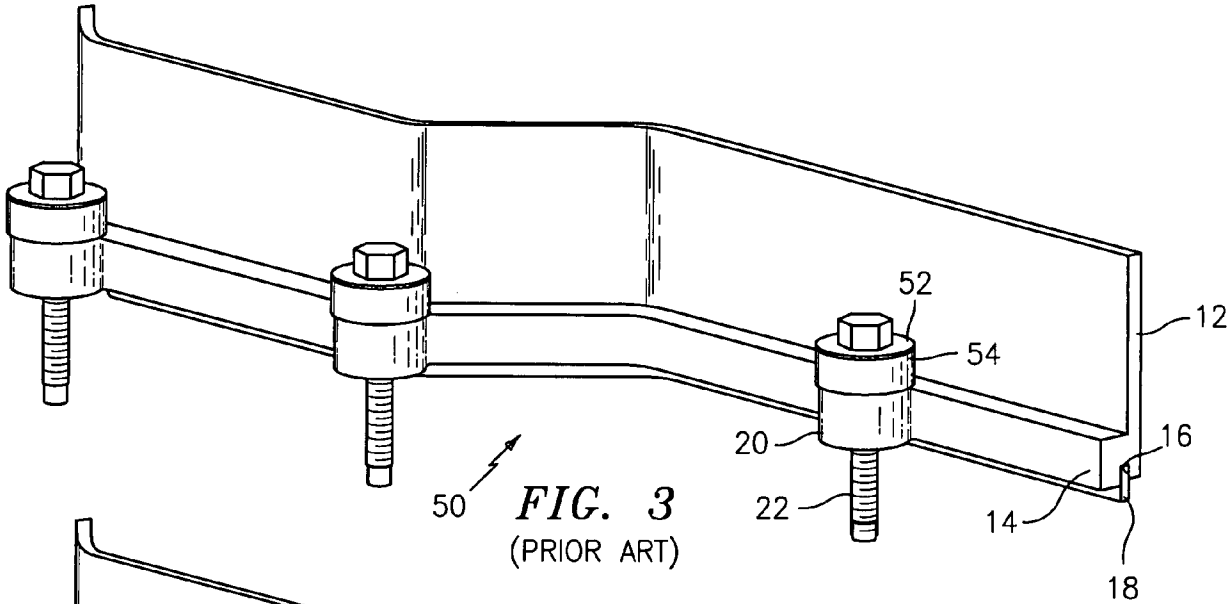
FIG. 3 (PRIOR ART)
FIG. 3 is a perspective view of a prior art rocker cover having a gasket in a groove of the rocker cover that is isolated from the cylinder head floating between the gasket and individual grommets, and includes a varying cover standoff height around a perimeter of the cover due to varying compression of the individual grommets.

FIGS. 1–3 illustrate partial perspective views of prior art cover assemblies 10, 30, and 50, respectively, for an engine cylinder head (not shown). FIG. 1 illustrates a gasket in groove rocker cover assembly 10 that is configured to be hard mounted to a cylinder head. Cover assembly 10 includes a cover 12 having a lip 14 defining a peripheral edge of the cover 12. Lip 14 includes a groove 16 configured to receive a gasket 18 disposed therein. Cover 12 includes a plurality of spaced bolt bosses 20 extending from lip 14 and configured to each receive a mechanical fastener 22 therethrough. Each mechanical fastener 22 is threadably received in a corresponding threaded aperture of the engine cylinder head to compress gasket 18 and form a seal between cover 12 and the cylinder head.

It will be noted in the above design that the standoff height is zero and that engine noise radiates from cover 12 due to full perimeter contact of lip 14 with the cylinder head. Furthermore, if gasket 18 fills groove 16, gasket 18 will hydraulically lift the joint potentially affecting the integrity of the gasket 18 and/or cover 12. Lastly, mid-span deflection of cover 12 (e.g., intermediate bolt bosses 20) is controlled by the structure of cover 12. In other words, cover 12 deflects less when cover 12 is structurally stiffer using a metal instead of plastic (e.g., a thermoset), for example. It will be recognized that less mid-span deflection occurs if each span between contiguous bolt bosses 20 is reduced by increasing a number of bolt bosses 20 and corresponding number of mechanical fasteners 22.

FIG. 2 illustrates a partial perspective view of a gasket in groove rocker cover assembly 30 that is configured to be hard mounted to a cylinder head only at bolt bosses 32 which extend below lip 14. Cover assembly 30 includes cover 12 having lip 14 defining a peripheral edge of the cover 12. Lip 14 includes groove 16 configured to receive gasket 18 disposed therein. Cover 12 includes a plurality of spaced bolt bosses 32 extending from a peripheral edge defining lip 14 and configured to each receive a mechanical fastener 22 therethrough. Bolt bosses 32 are defined with a bottom surface 34 that extend further towards the cylinder head than a bottom surface 36 defining lip 14 to make contact with the cylinder head.

In this manner, it will be noted that the above-described design provides a controlled standoff height determined by a length of bosses 32 extending below bottom surface 36 defining lip 14. Thus, engine noise radiates from cover assembly 30 due to contact of the cylinder head with bosses 32 while engine noise is dampened by gasket 18 in the mid-spans 40 between contiguous bosses 32. Furthermore, gasket 18 will not hydraulically lift the joint because of the standoff distance in the mid-spans 40 provided by bosses 32 allowing expansion of gasket 18 in the joint intermediate contiguous bosses 32 corresponding to the mid-spans. Lastly, mid-span deflection of cover 12 (e.g., intermediate bolt bosses 20) is controlled by the structure of cover 12 as described in FIG. 1.

FIG. 3 illustrates a partial perspective view of a gasket in groove rocker cover assembly 50 that is isolated from the engine cylinder head. Cover assembly 50 includes cover 12, lip 14, groove 16, gasket 18, and bosses 20, as in FIG. 1. However, cover assembly 50 further includes each mechanical fastener 22 (e.g., bolt) extending through a height limiter 52 and a grommet 54 before extending through a corresponding bolt boss 20 and into a corresponding threaded aperture of the cylinder head. In this manner, cover 12 floats between gasket 18 and the plurality of grommets 54. In addition, since a length of each height limiter 52 is more than a height of lip 14 and is less than or equal to a combined height of an uncompressed grommet 54 and lip 14, height limiter 52 provides a standoff distance eliminating a potential of gasket 18 to hydraulically lift the joint.

However, a sealing pressure of gasket 18 varies with the bolting pattern in this configuration. Thus, the cover standoff height is uncontrolled around a perimeter of cover 12 due to individual compression variations of each grommet 54. As such, engine noise radiating from cover assembly 50 varies with the compression of the grommets 54 and gasket 18. Furthermore, uneven compression may affect the long term integrity of gasket 18 and grommets 54. As before, mid-span deflection is controlled by cover structure.

Figure 4:
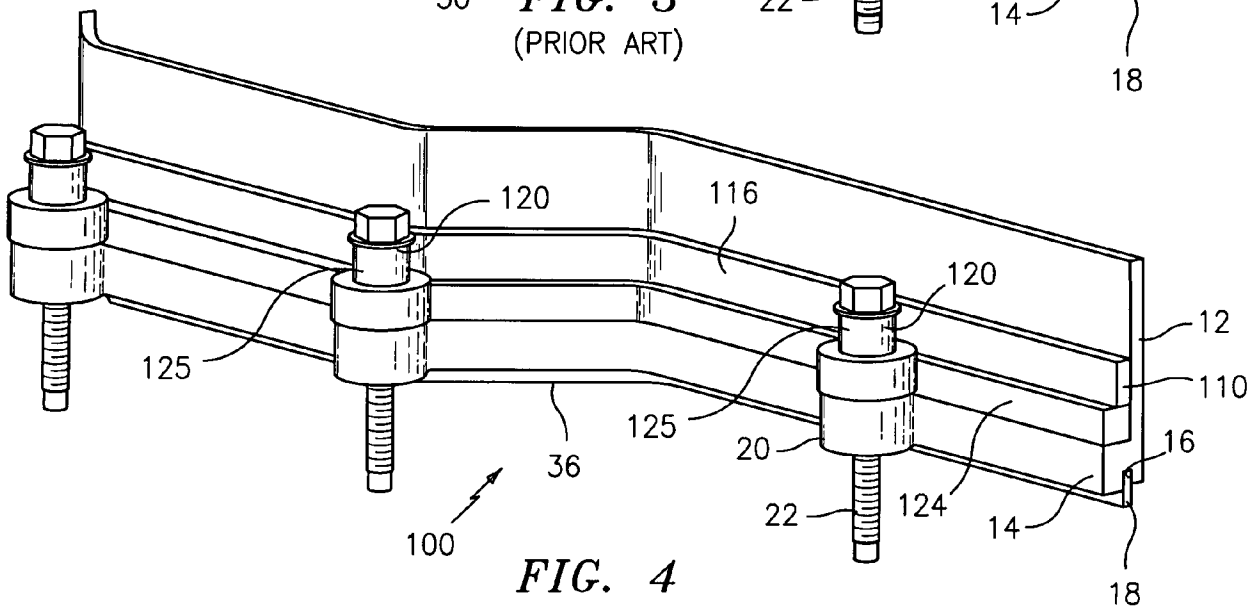
FIG. 4 is a perspective view of a rocker cover assembly having the cover of FIGS. 1 and 3 isolated from the cylinder head floating between a gasket and a reaction pad having a uniform cover standoff height around a perimeter of the cover due to a uniform reaction load provided by a brace in accordance with an exemplary embodiment.

FIG. 4 illustrates a gasket in groove cover assembly 100 that overcomes the deficiencies noted above with respect to FIG. 3. Cover assembly 100 includes cover 12, lip 14, groove 16, gasket 18, and bolt bosses 20, as in FIGS. 1 and 3. Cover assembly 100 defines a fluid containing wall via cover 12 surrounded by a peripheral edge defined by lip 14 having an inwardly facing sealing surface 36. Cover assembly 100 further includes a brace 110 disposed on a top surface 112 opposite bottom sealing surface 36 defining lip 14. Brace 110 includes a rigid bar 116 extending around a periphery defining a perimeter of cover 12 and is disposed on the top surface 112 defining lip 14. Bar 116 includes a plurality of height limiters 120 depending therefrom and aligned with corresponding bolt bosses 20. Each height limiter 120 is configured as a cylinder, but is not limited thereto, having an aperture 122 to receive a corresponding mechanical fastener 22 therethrough (see FIG. 5). A reaction pad 124 is disposed intermediate brace 110 and lip 14 such that a compressive pressure from brace 110 on lip 14 is via reaction pad 124 as best seen with reference to FIG. 5.

Although the drawings depict groove 16 in sealing surface 36, groove 16 is optional. The sealing surface 36 of cover 12 optionally includes a groove 16 into which some of gasket 18 is displaced so that the interaction with the groove prevents the sealing material or gasket 18 from being easily dislodged from the gap between the sealing surfaces and maintains the sealing material in position under all conditions of operation of the engine.

Bar 116 is vertically oriented such that a first cylinder 125 defining each height limiter 120 extends from a broad externally exposed surface defining bar 116. In this vertical orientation, bar 116 is less susceptible to bending when a vertical force is applied via mechanical fasteners 22 and allows the vertical force to be uniformly supplied about a perimeter defining bar 116. In an exemplary embodiment, bar 116 and each height limiter 120 is made of steel for simplicity in fabrication of brace 110 and cost. However, any material is contemplated that is suitable to provide a uniform load on lip 14 about a perimeter thereof without significant deflection in mid-span regions between contiguous mechanical fasteners 22.

Figure 5:
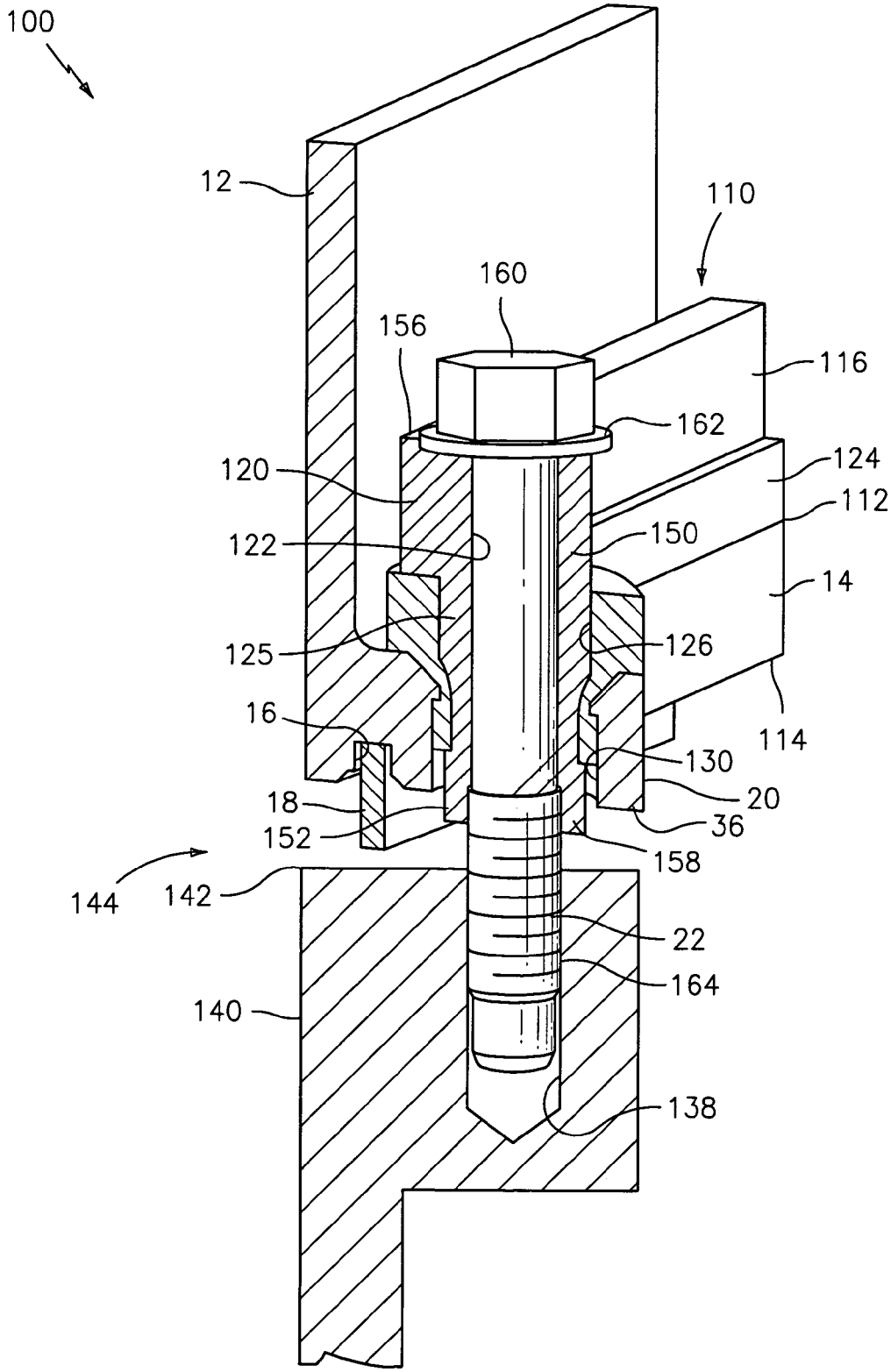
FIG. 5 is a partial cross-section view at one of the bolt bosses of the rocker cover assembly shown in FIG. 4 and an engine cylinder head to which it is operably coupled in accordance with an exemplary embodiment.

Referring to FIGS. 4 and 5, each mechanical fastener 22 (e.g., bolt) extends through aperture 122 of a corresponding height limiter 120 and an aperture 126 configured in reaction pad 124. Each aperture 126 of reaction pad 124 is aligned with an aperture 130 extending through each bolt boss 20. Each fastener 22 extends through height limiter 120, through a corresponding bolt boss 20, and into a corresponding threaded aperture 138 of an engine cylinder head 140. In this manner, cover 12 floats between gasket 18 disposed on a surface 142 defining cylinder head 140 and reaction pad 124 compressed over its perimeter via brace 110. Thus, a uniform standoff distance is provided around a perimeter defining cover 12 and a potential for gasket 18 to hydraulically lift the joint between surface 142 defining head 140 and surface 114 defining a bottom of cover 12 is eliminated.

FIG. 5 illustrates a partial cross section view of at least one cylinder head 140 having an open top with an outwardly facing generally planar sealing surface 142. The open top is closed by the sealed cover assembly 100 defining an internal fluid containing cavity with the cylinder head generally indicated at 144. FIG. 5 depicts cover assembly 110 prior to tightening fasteners 22 to articulate brace 110 toward surface 142 of head 140 to provide a compressive force on reaction pad 124 and gasket 18. Therefore, the gasket sealing pressure variation along a perimeter defining gasket 18 is controlled by a strength of brace 110 and is not dependent on the bolt pattern as in FIG. 3. However, it will be recognized that uniform compression provided by brace 110 with the aid of a substantially uniform bolt pattern improves long term system performance. It will also be noted that non-uniform bolt patterns only have a minor influence over the sealing performance when using brace 110.

In an exemplary embodiment shown in FIG. 5, each height limiter 120 is configured as a sleeve 150 having a height limiting tubular body 152 defined by a first end 156 and terminating at an opposite second end 158. The second end 158 extends through aperture 130 of bolt boss 20 facing the cylinder head sealing surface 142. The mechanical fastener 22 includes a bolt having a head end 160 incorporating a flange 162 that engages the first end of height limiter tubular body 152. The main body of the bolt extends through the sleeve body 152 (i.e., aperture 126) with a threaded end 164 protruding beyond the sealing surface 36 of lip 14. A mechanical fastener 22 is installed within each of the cover openings and is retained within its respective opening by any suitable means to form the sealed cover assembly adapted for assembly onto the cylinder head.

For mounting of the cover assembly 100 on the cylinder head 140, cooperating threaded openings 138 are provided in the cylinder head into which the ends 164 of the bolts are threaded to mount the cover 12 onto the cylinder head 140. Prior to the assembly step, a sealing material or gasket 18 is disposed in groove 16 of cover 12. The cover assembly 100 is then positioned opposite the engine sealing surface 142. The bolts 22 are then threaded into their corresponding openings 138 in the cylinder head and tightened down until the bolt head flanges 162 engage the sleeves 150 and the opposite second ends 158 engage sealing surface 142 of cylinder head 140, which establishes the predetermined compression of gasket 18 along with partial compression of reaction pad 124. In an exemplary embodiment, if reaction pad 124 and gasket 18 have a similar spring rate, compression of the gasket is equal to compression of the reaction pad so that the mounting forces applied thorough the gasket 18 and reaction pad 124 on the cover 12 are balanced. The cover is thereby retained in a position with its sealing surface 36 spaced outward, by a predetermined gap dimension or standoff height, from the sealing surface 142 of the cylinder head.

It will be further recognized that since reaction pad 124 is continuous about a perimeter of cover 12 with a uniform load provided by brace 110, reaction pad 124 may be softer or have a lower durometer than the grommets 54 of FIG. 3. Brace 110 spreads the reaction load of the harder grommets 54 of FIG. 3 over a larger softer reaction pad 124 with lower stress levels realized by reaction pad 124. Furthermore, reaction pad 124 will realize less compressive pressure than grommets 54 and less engine noise will be transferred to cover 12. Engine noise radiating from cover 12 can be adjusted by adjusting a height of the height limiters 120 that extend through apertures 126 and 130. Alternatively, or in addition to, the engine noise radiating from cover 12 can be adjusted by selecting a reaction pad 124 material having a lower or higher durometer. A higher durometer reaction pad 124 allows more engine noise to be radiated from cover 12 while a lower durometer reaction pad 124 limits engine noise that is transferred to cover 12 and radiated therefrom. In an exemplary embodiment, reaction pad 124 is a silicon material similar to gasket 18, however, other materials are contemplated suitable to provide a uniform reaction load with respect to lip 14 of cover 12 acting thereon.

Reaction pad 124 is preferably molded as a one-piece integral member. The hardness and compression rate of the reaction pad material are preferably uniform throughout the molded reaction pad 124 so that both sides defining a thickness of the grommet compress equally from an extended initial length shown in FIG. 5 to the installed length (not shown). Hardness and compression of the reaction pad 124 are pre-selected as desired to support the cover 12 and to control noise isolation of the cover from the vibration of the cylinder head and engine.

As described above, cover assembly 100 eliminates mid-span deflection due to the uniform reaction load from brace 110 around a perimeter defining cover 12. In other words, brace 110 provides all of the structural load requirements that gasket 18 places on cover 12. Since a uniform reaction load about the perimeter of cover 12 is provided by brace 110, the cover structure of cover 12 is only required to maintain its shape.

The design of the cover assembly promotes a long life installation since the position of the cover is balanced by gasket 18 and reaction pad 124 at all attachment points so that no distortion or rotation of the cover due to gasket reaction loadings occurs. Thus, alternative cover materials which provide ideal mass and cost considerations may be utilized without concern as to substantial stresses placed on the cover by having to load a seal material against the cylinder head. For example, this allows cover 12 to be manufactured from a recyclable thermoplastic instead of a non-recyclable thermoset material currently employed or a metal. Using a recyclable thermoplastic cover 12 results in significant cost savings.

As the name suggests, a thermoset is a material (such as rubber) that cures or hardens (sets) into a given shape, generally through the application of heat (a thermal increase). Curing (also referred to as vulcanizing) is an irreversible chemical reaction in which permanent connections (known as cross-links) are made between the material's molecular chains. Thermoset polymers outperform other materials, such as thermoplastics, in a number of areas, including mechanical properties, chemical resistance, thermal stability, and overall durability. For these reasons, thermoset parts tend to make more effective seals. However, a cured thermoset material will not remelt or otherwise regain the processibility it had before being cured, as curing changes the material forever.

A thermoplastic material softens (becomes pliable and plastic) when heated, but it does not cure or set. A thermoplastic often begins in pellet form, then becomes softer and more fluid as heat increases. This fluidity allows it to be injected under pressure from a heated cavity into a cool mold. As it cools, the thermoplastic will harden in the shape of the mold, but there is no chemical curing at work. No cross-links are formed as with a thermoset material. The changes seen in the thermoplastic are purely physical and, with the reapplication of heat, wholly reversible. A thermoplastic material can therefore be reprocessed many times, though continual recycling will eventually degrade the polymer. Furthermore, by using brace 110 in conjunction with a thermoplastic cover 12, the strength lost by using a thermoplastic instead of a thermoset may be regained and significant cost savings are realized by using a recyclable thermoplastic.

While the exemplary cover assembly design illustrated involves a number of specific design considerations, the brace and cover concept can be utilized with other cover designs to isolate a cover of any type from an associated engine component on which it is mounted. If desired, the integral height limiters 120 could be replaced by separate individual height limiters 120 attachable to bar 116 forming a variable height limiter assemblies having equal compression characteristics to provide the balanced mounting assembly of the invention. However, a single height limiter fixedly attached to the bar 116 for each mounting location is preferred for ease of manufacture, assembly and parts retention. If necessary, a variable thickness reaction pad 124 could be utilized to perform the same function of the separate individual height limiters of variable height in place of the variable height limiter design.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A sealed cover assembly for a fluid-containing cavity of an engine, the cover assembly comprising:

a cover including a fluid-containing wall with a peripheral edge having a sealing surface adapted to oppose a corresponding sealing surface of the engine, and a plurality of mounting openings in the peripheral edge;

a reaction pad adjacent each of the openings and disposed at the peripheral edge on an opposite surface of the sealing surface around a perimeter defining the cover;

a brace disposed against the reaction pad around the perimeter defining the cover; and mechanical fasteners extending through the reaction pad and the brace for securing the cover to a mating edge of the engine cavity, the fasteners when engaged providing substantially equal compression forces on the reaction pad via the brace and supporting the cover sealing surface with a predetermined gap from the cavity mating edge for engagement with a compliant sealing material disposed between the surfaces.

2. The sealed cover assembly as in claim 1, wherein the brace includes a plurality of height limiters depending therefrom and aligned with each of the openings.

3. The sealed cover assembly as in claim 2, wherein the height limiters each include a height controlling sleeve and the mechanical fasteners each include a bolt extending through the sleeve and adapted to compress the sealing material to a predetermined height whereby the predetermined gap is obtained between the peripheral sealing surface of the cover and the engine sealing surface.

4. The sealed cover assembly of claim 3, wherein when the predetermined gap is obtained, further tightening of the mechanical fasteners only compresses the reaction pad.

5. The sealed cover assembly as in claim 2, wherein the reaction pad extends into at least a portion of the openings isolating the height limiters from the peripheral edge of the cover.

6. The sealed cover assembly as in claim 2, wherein the height limiters and brace are formed of steel.

7. The sealed cover assembly as in claim 1, wherein the sealing material includes a formed sealing material engaging the cover sealing surface for closing the gap and preventing the escape of fluid from an engine cavity closed by the cover.

8. The sealed cover assembly as in claim 7 wherein the formed sealing material is a molded silicone compound.

9. The sealed cover assembly as in claim 7 wherein the cover sealing surface includes a linear groove for receiving the sealing material prior to installation of the cover assembly.

10. The sealed cover assembly as in claim 7 wherein the compliant sealing material is a high compression seal.

11. The sealed cover assembly as in claim 1 wherein the reaction pad is a unitary member.

12. The sealed cover assembly as in claim 1, wherein the cover is formed of a thermoplastic.

13. The sealed cover assembly as in claim 1, wherein the brace is configured as a bar surrounding a perimeter of the cover, the bar being defined by a broad surface thereof facing the wall defining the cover while an edge defining the bar faces the peripheral edge of the cover.

14. An engine cover assembly defining a fluid-containing cavity the assembly comprising:

an engine component including a sealing surface defining an edge of the cavity;

a cover including a fluid-containing wall surrounded by a peripheral edge and having a sealing surface opposing the sealing surface of the engine component, and a plurality of mounting openings in the wall;

a reaction pad adjacent each of the openings and disposed at the peripheral edge on an opposite surface of the sealing surface around a perimeter defining the cover;

a brace disposed against the reaction pad around the perimeter defining the cover, the brace including a plurality of height limiters depending therefrom and aligned with each of the openings; and mechanical fasteners extending through the reaction pad and each height limiter for engaging the engine component for securing the cover to the engine component, the fasteners when engaged providing equal compression forces on the reaction pad via the brace and supporting the cover sealing surface with a predetermined gap from the cavity mating edge for engagement with a compliant sealing material disposed between the surfaces.

15. The engine cover assembly as in claim 14, wherein the cover is formed of a thermoplastic.

16. The engine cover assembly as in claim 15, wherein the height limiters each include a height controlling sleeve and the mechanical fasteners each include a bolt extending through the sleeve and adapted to compress the sealing material to a predetermined height whereby the predetermined gap is obtained between the peripheral sealing surface of the cover and the engine sealing surface.

17. The sealed cover assembly of claim 16, wherein when the predetermined gap is obtained, further tightening of the mechanical fasteners only compresses the reaction pad.

18. A method for sealing an engine cavity, the method comprising:

configuring a cover including a fluid-containing wall with a peripheral edge having a sealing surface adapted to oppose a corresponding sealing surface of an engine;

configuring a plurality of mounting openings in the peripheral edge;

disposing a reaction pad adjacent each of the openings and around at the peripheral edge on an opposite surface of the sealing surface around a perimeter defining the cover;

disposing a brace against the reaction pad around the perimeter defining the cover; and extending mechanical fasteners through the reaction pad and the brace for securing the cover to a mating edge of the engine cavity, the fasteners when engaged providing equal compression forces on the reaction pad via the brace and supporting the cover sealing surface with a predetermined gap from the cavity mating edge for engagement with a compliant sealing material disposed between the surfaces.

19. The method as in claim 18, wherein the brace includes a plurality of height limiters depending therefrom and aligned with each of the openings.

20. The method as in claim 18, wherein the cover is formed of a thermoplastic.

* * * * *